US006520050B1

(12) United States Patent
Gildroy

(10) Patent No.: US 6,520,050 B1
(45) Date of Patent: Feb. 18, 2003

(54) FINISH CARPENTRY NAILING GUARD

(76) Inventor: Grant Gildroy, 124 Crescent Rd., Corte Madera, CA (US) 94925

( * ) Notice: Subject to any disclaimer, the term of this patent is extended or adjusted under 35 U.S.C. 154(b) by 0 days.

(21) Appl. No.: 09/415,410

(22) Filed: Oct. 8, 1999

Related U.S. Application Data

(60) Provisional application No. 60/103,817, filed on Oct. 8, 1998.

(51) Int. Cl.[7] ..... B25C 3/00
(52) U.S. Cl. ..... 81/44
(58) Field of Search ..... 81/44, 487

(56) References Cited

U.S. PATENT DOCUMENTS 1,293,394 A * 2/1919 Fiori ..... 81/44
3,010,496 A * 11/1961 Bruce ..... 81/44
3,682,213 A * 8/1972 Litz ..... 81/44
4,079,764 A * 3/1978 Hayes ..... 81/44
4,194,546 A * 3/1980 Wooley ..... 81/44
4,282,615 A * 8/1981 Tom ..... 7/164
4,966,056 A * 10/1990 Miller ..... 81/44
5,284,070 A * 2/1994 Rieck ..... 81/44
5,671,641 A * 9/1997 Stephenson, Jr. ..... 81/44
5,933,894 A * 8/1999 Bates ..... 81/44
5,957,007 A * 9/1999 Righini ..... 81/44

FOREIGN PATENT DOCUMENTS

IT 585964 * 11/1958 ..... 81/44

* cited by examiner

*Primary Examiner*—Eileen P. Morgan
*Assistant Examiner*—Joni B. Danganan
(74) *Attorney, Agent, or Firm*—Larry D. Johnson; Craig M. Stainbrook; Johnson & Stainbrook, LLP

(57) ABSTRACT

A finish carpentry nailing guard adapted for use in protecting workpiece surfaces from damage by hammers while driving nails and/or from nail pulling devices when removing nails, the guard comprising a unitary block having a centrally located aperture and/or slots. In its preferred embodiment the guard is transparent and fabricated from lexan or other hard plastic.

5 Claims, 2 Drawing Sheets

FINISH CARPENTRY NAILING GUARD

This application claims the benefit of U.S. Provisional Patent Application, Ser. No. 60/103,817, filed Oct. 8, 1998, by applicant herein.

BACKGROUND OF THE INVENTION

1. Field of the Invention

The present invention relates generally to carpentry tools, and more particularly to a finish carpentry nailing guard used to prevent damage to the surface worked upon when driving or pulling nails.

2. Description of the Prior Art

Since the invention of hammers and nails, accomplished and unskilled carpenters alike have injured fingers and damaged valued surfaces with mishits while driving nails. Accordingly, the prior art includes several devices adapted for use as nail starters, nail holders, and/or nailing shields. However, the present invention improves on the prior art in providing a simpler and more effective guard against damaging a workpiece, particularly one with valuable finish surfaces, when either driving or pulling nails.

SUMMARY OF THE INVENTION

The present invention is a finish carpentry nailing guard adapted for use in protecting workpiece surfaces from damage by hammers while driving nails and/or from nail pulling devices when removing nails. In its simplest embodiment, the nail guard comprises a unitary block having a centrally located aperture and a slot positioned in one corner running interiorly towards the center. Preferably the block is substantially cuboid and has a length, a width, and a depth, a top side, and a bottom side, four corners, and the centrally located aperture passes through the block from the top to the bottom side. However, any number of shapes may be employed, including irregular shapes. Instead of or in addition to the aperture, the block may have slots for holding nails in place while being started into workpiece. Preferably the guard is fabricated from lexan or other hard plastic, and preferably it is transparent. The size is suitable for holding and placing the block flat against a surface to be nailed on a workpiece, and the aperture in the block is of a dimension to accommodate most commonly used nails.

In use, the workman starts a nail into the workpiece and thereafter places the guard over the workpiece by inserting the nail head through the aperture. Alternatively, the guard is pressed against the nailing surface with the aperture over the exact place to be nailed; then, a nail point is placed through the aperture and held in place with the same hand pressing the guard against the nailing surface. Using this latter method, once the nail is sufficiently started into the workpiece, the fingers holding the nail may be withdrawn from immediate proximity with the nail and the nail driven more forcefully by stronger blows with the hammer. It is at this point that the guard offers its most salient protection, for if and when the nail is mishit, the hammer will not damage the nailing surface, whether wood or other material, as the block will absorb and distribute the force over the entire portion of the bottom surface area of the guard in contact with the workpiece surface.

When the nail has been driven to the point that its head is level with the top surface of the guard, the guard may then be lifted over the nail head and the nail further driven with the care and force appropriate to the task. Alternatively, a nail set may be used with the guard in place to sink finish nails to an appropriate depth. If the workman elects to lift the guard off the nail before setting it, the bottom surface of the guard may be placed directly over the nail head so that the nail is seen through the guard, and the nail may be hammered down to flush with the nailing surface by tapping the top of the block rather than the nail head. This method eliminates the possibility of damage by mishits and softens the final blows that set the nail.

The nail guard of the present invention is easily adaptable for use as a guard when pulling nails with claw hammers or other nail pulling devices. It is also well adapted for use as a guard when using power drills with screw nails.

DETAILED DESCRIPTION OF A PREFERRED EMBODIMENT

Figure 1:
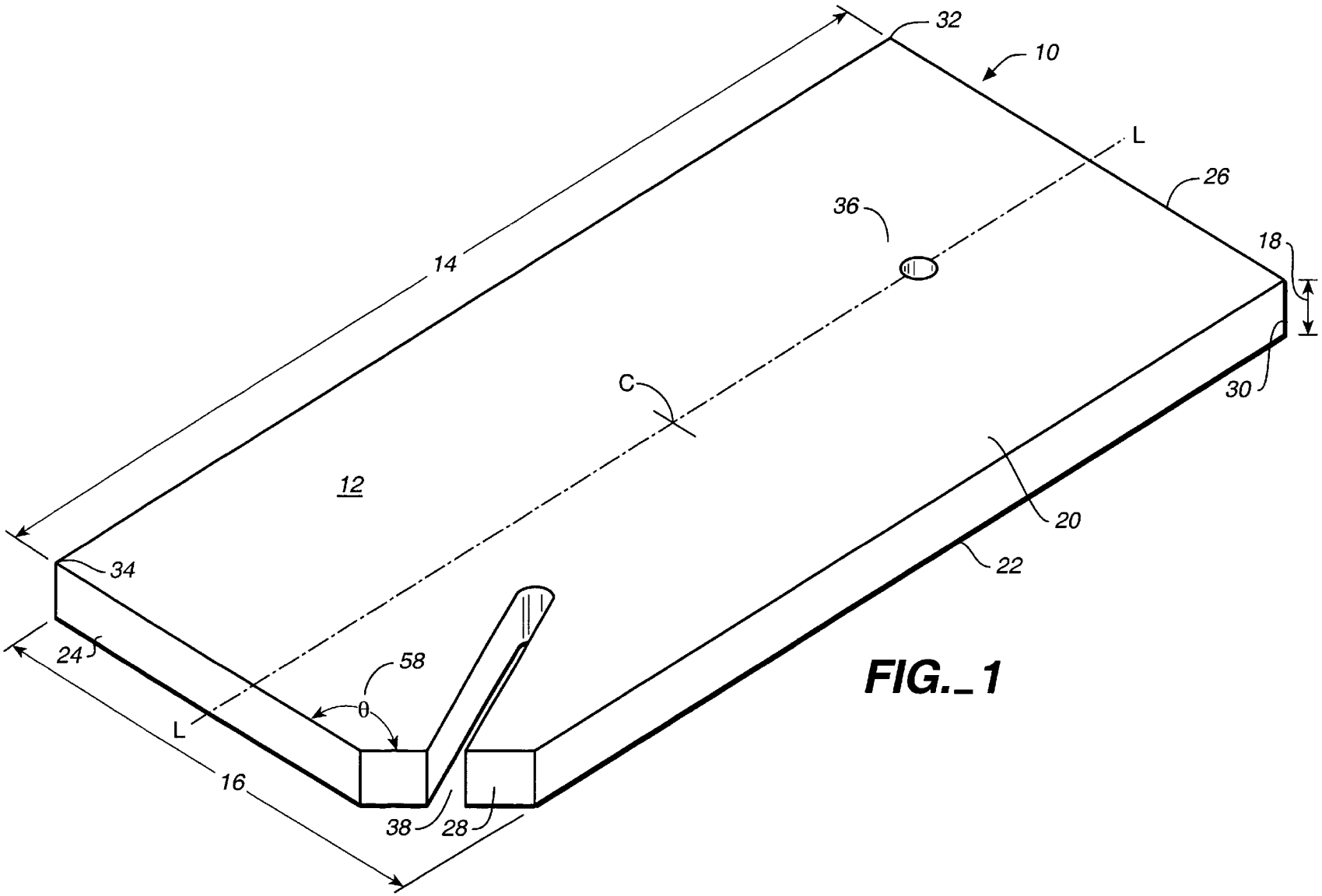
FIG. 1 is a perspective view of the first preferred embodiment of the finish carpentry nailing guard of the present invention.

The first preferred embodiment of the present invention, shown in perspective view in FIG. 1 and generally denominated 10, is a finish carpentry nailing guard adapted for use in protecting surfaces from damage by hammers while driving nails and/or from nail pulling devices when removing nails. In this first preferred embodiment, the nail guard comprises a unitary cuboid block 12 having a length 14, a width 16, a depth 18, a top side 20, a bottom side 22, a longitudinal axis L, a center C, a first end 24, a second end 26, a first corner 28, a it second corner 30, a third corner 32, a fourth corner 34, at least one small aperture 36 passing through the block from the top to the bottom side and located along the longitudinal axis slightly closer to one of said first or second ends, and a slot 38, located at the first corner and running at an approximate 45 degree angle relative to the first side 24, and running inwardly toward the longitudinal axis. Preferably the guard is transparent and is fabricated from a polycarbonate resin sheet material and molding compound, such as LEXAN, or another hard, shatter proof plastic, though it may be fabricated from any number of suitably hard materials. (LEXAN is a registered trademark of the General Electric Company Corporation New York.)

Although the present invention is substantially cuboid in its first preferred embodiment, the essential function and guarding properties may be achieved with any of a number of suitable shapes, including irregular shapes, having a flat upper surface and a flat lower surface, at least one aperture and/or at least one slot, and dimensions suitable for easy manipulation over a workpiece.

The length, width, and depth dimensions of the first preferred embodiment make the guard generally rectangular and suitable for easy holding and manual manipulation. Furthermore, the depth 18 is sufficient to withstand substantial blows by hammers and other nail driving devices while being shallow enough to drive the nail head to near a finish position. The aperture 36 in the block is of a dimension to accommodate the shaft and head of most commonly used nails when passed lengthwise through the aperture.

Figure 2:
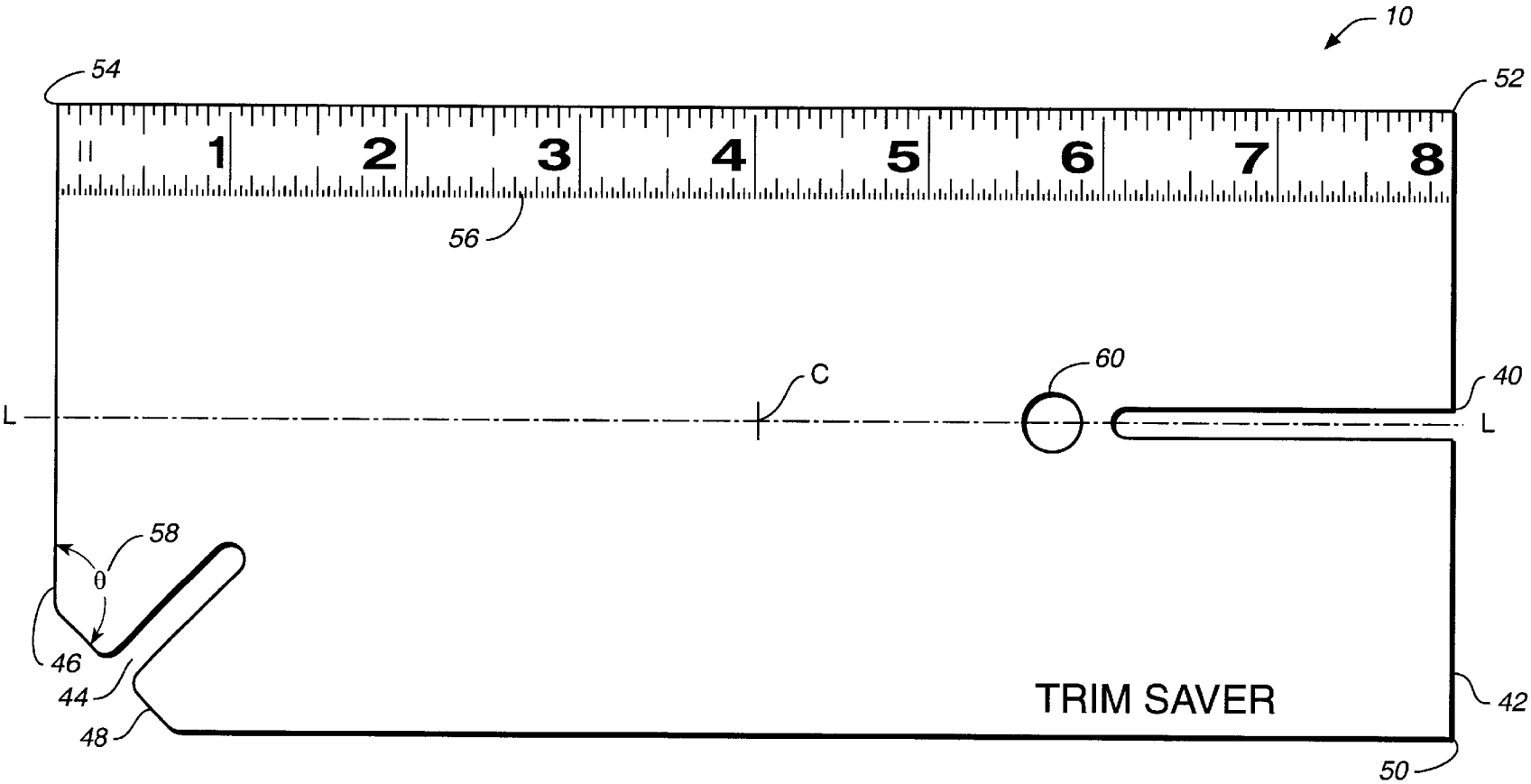
FIG. 2 is a top view of a second preferred embodiment of the nailing guard.

In a second preferred embodiment, shown in FIG. 2, the nail guard includes at least one slot or channel, preferably two, a second 40 located at a second end 42 of said block and running along the longitudinal axis L toward the center C of the block, and a first slot 44 located at a first end 46 of the block in the first corner 48 of the four corners of the block, 48, 50, 52, and 54, respectively. The second slot has a length roughly equal to its distance from either edge of the block, as this configuration provides optimum distribution of the force of blows to the block while yet providing optimum access and flexibility in setting and removing nails. The second slot runs at a substantially 45 degree angle from the edge of the block toward the longitudinal axis. The first corner is trimmed or formed at an approximate 45 degree angle to increase strength. The slots may be provided in addition to or instead of the aperture as depicted in FIG. 1. As a matter of convenience for the workman, measurement markings 56 may be integrated into an edge of the guard. Aperture 60 may be located anywhere along the longitudinal axis between the first and second ends, though preferably between the middle of the nailing guard and the second slot.

In either of the preferred embodiments, because of the location along the longitudinal axis of the aperture and/or slots, the workman is able to use the guard to drive and pull nails in virtually any work space while taking advantage of its protective features. In the first preferred embodiment, the central location of the aperture along the longitudinal axis of the block ensures that the force from mishits landing on the guard is distributed and disbursed over the broadest region possible, thus minimizing forces at the edges where impressions may be made in the workpiece surface. In the second preferred embodiment, the central location of the first slot also achieves this result. As neither the first and second slots nor the aperture are intended to hold a fastener during nailing, in each embodiment the slots and the aperture do not angle from the top side 20 of the nailing guard to the bottom side 22, but pass straight through, instead.

To use the guard, the workman starts a nail with appropriately gentle hammer blows and, when the nail is sufficiently stable, places guard over the nail by inserting the nail head through the aperture or into the slot. Alternatively, the workman presses the guard against the nailing surface with the aperture over the spot to be nailed, places a nail point through the aperture or at the interior end of a slot and holds the nail in place with fingers of the same hand pressing the guard against the nailing surface. The nail is then driven to a sufficient depth so that it is stable without holding, and the fingers holding the nail may then be withdrawn from immediate proximity with the nail while the guard is still pressed in place. At this point nail may be driven more forcefully by stronger and more confident blows with the hammer. If the nail is mishit, the hammer will not damage the nailing surface because the guard will absorb and distribute the force of the blow over the entire portion of the bottom surface area of the guard in contact with the nailing surface. When the nail head is level with the top surface of the guard, the guard may be lifted over the nail head or slid out from under the nail and the nail further driven carefully with cautious blows. Alternatively, the nail may be sunk with the guard in place with a nail set. Again, alternatively, the guard may be placed directly over the nail so that the nail head may be visualized through the guard. Then, using the guard as a nail set, the workman may hammer the nail flush with the surface by tapping the top of the block rather than the nail head. This entirely eliminates damage caused by mishits and actually minimizes even the effect of all but the most clumsy hammer strikes by focusing off center hits directly onto the nail head. The transparent plastic makes it much easier to strike effective blows on the guard and directly on or near the nail head.

The nail guard of the present invention has several other uses that highlight its flexibility and adaptability in the work place. For example, the guard may be used as an ordinary "beater block" to square corners, move mitered pieces into alignment with adjoining pieces, and the like. In its preferred embodiment as a generally rectangular block, it may also be used to confirm the squareness of corners.

The guard is also particularly well adapted for use with power drills to sink screw nails. Use of power drills is an increasingly common method of inserting fasteners in construction and manufacturing. While offering a stronger fastening and connection means than nailing, skilled workmen using drills become obsessed with speed and efficiency and frequently become careless, inadvertently allowing the drill to slip off the screw head and mar the workpiece surface. The nail guard of the present invention prevents this damage.

The foregoing features of the present invention reveal its most important advantage: namely, stress reduction. Particularly when nailing valuable finish surfaces that show any damage or imperfection, the guard provides a high degree of ease and comfort for the workman. While no studies have been conducted to confirm the hypothesis, it seems reasonable to expect this to have a generally salubrious effect on users.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A finish carpentry nailing guard adapted for protecting workpiece surfaces from damage by hammers while driving nails into, and/or from nail pulling devices when removing nails from, a workpiece, said nailing guard comprising:

a unitary, substantially cuboid transparent polycarbonate block suitably sized for easy handling and manipulation by the human hand, said block having a flat top side and a flat bottom side, a length, a width, a depth, a first end and a second end, a first, second, third and fourth corner, a longitudinal axis, and a center, wherein said flat bottom side is adapted for placement against the surface of the workpiece, wherein said block protects the workpiece surface from damage by the hammer or nail pulling device by preventing contact with the workpiece surface;

an aperture passing straight through the block from the top side to the bottom side, said aperture located along said longitudinal axis and adapted to accommodate a single nail passed lengthwise through the aperture for nailing into the workpiece or pulling from the workpiece; and a first slot for accommodating and holding at least one nail for driving into a workpiece surface, wherein said first slot angles inwardly from said first corner toward said longitudinal axis and passes straight through from said top side to said bottom side.

2. The nailing guard of claim 1 wherein said block further has a second slot located at said second end of said cuboid block and runs along said longitudinal axis of said block toward said middle of said block.

3. The nailing guard of claim 2 wherein said first corner is trimmed at a substantially 45 degree angle relative to said first end to accommodate said first slot.

4. A finish carpentry nailing guard comprising:

a substantially cuboid transparent polycarbonate block sized for easy handling and manipulation by the human hand, said block having a flat top side and a flat bottom side, a length, a width, a depth, a first end and a second end, first through fourth corners, a longitudinal axis, a center, wherein said flat bottom side is adapted for placement against the surface of the workpiece;

a first slot for accommodating and holding at least one nail for driving into a workpiece surface, wherein said first slot angles inwardly from said first corner toward said longitudinal axis, wherein said first corner is trimmed at a substantially 45 degree angle relative to said first end to accommodate said first slot, said first slot passing straight through from said top side to said bottom side;

a second slot located at said second end of said cuboid block and running along said longitudinal axis of said block toward said middle of said block, said second slot passing straight through from said top side to said bottom side; and an aperture located along said longitudinal axis and passing straight through said block from said top side to said bottom side, wherein said aperture accommodates a single nail passed lengthwise through the aperture for nailing into the workpiece or pulling from the workpiece.

5. A method of protecting a work piece surface from damage while securing a fastener with a hammer, and for finishing the fastener to a level flush with the surface of the work piece, said method comprising the steps of:

providing a finish carpentry nailing guard adapted for protecting workpiece surfaces from damage by hammers while driving nails into, and/or from nail pulling devices when removing nails from, a workpiece, said nailing guard comprising a unitary, substantially cuboid transparent polycarbonate block suitably sized for easy handling and manipulation by the human hand, said block having a flat top side and a flat bottom side, a length, a width, a depth, a first end and a second end, a first, second, third and fourth corner, a longitudinal axis, and a center, wherein said flat bottom side is adapted for placement against the surface of the workpiece, wherein said block protects the workpiece surface from damage by the hammer or nail pulling device by preventing contact with the workpiece surface; an aperture passing straight through the block from the top side to the bottom side, said aperture located along said longitudinal axis and adapted to accommodate a single nail passed lengthwise through the aperture for nailing into the workpiece or pulling from the workpiece; and a first slot for accommodating and holding at least one nail for driving into a workpiece surface, wherein said first slot angles inwardly from said first corner toward said longitudinal axis and passes straight through from said top side to said bottom side;

starting a fastener into the workpiece without use of the nailing guard;

placing the guard over the fastener either through the aperture or the first slot;

driving the fastener into the workpiece with the hammer until the head of the fastener is substantially level with the top side of the nailing guard;

placing the bottom side of the nailing guard over the head of the fastener and visualizing the fastener through the transparent material comprising the guard;

sinking the fastener head to the level of the work piece surface by hammering the nailing guard directly over the fastener head.

* * * * *